US007839336B2

(12) United States Patent
Koshiji et al.

(10) Patent No.: US 7,839,336 B2
(45) Date of Patent: Nov. 23, 2010

(54) ANTENNA APPARATUS

(75) Inventors: Fukuro Koshiji, Tokyo (JP); Toshiya Eguchi, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 250 days.

(21) Appl. No.: 12/065,863

(22) PCT Filed: Aug. 18, 2006

(86) PCT No.: PCT/JP2006/316208

§ 371 (c)(1),
(2), (4) Date: Mar. 5, 2008

(87) PCT Pub. No.: WO2007/032178

PCT Pub. Date: Mar. 22, 2007

(65) Prior Publication Data

US 2009/0128422 A1 May 21, 2009

(30) Foreign Application Priority Data

Sep. 14, 2005 (JP) ..... 2005-266935

(51) Int. Cl.
*H01Q 1/38* (2006.01)
*H01Q 9/28* (2006.01)

(52) U.S. Cl. ..... 343/700 MS; 343/793; 343/795; 343/702

(58) Field of Classification Search ..... None
See application file for complete search history.

(56) References Cited

U.S. PATENT DOCUMENTS

| | | | | |
|---|---|---|---|---|
| 2,511,849 | A | 6/1950 | Hilferty et al. | |
| 5,986,609 | A | 11/1999 | Spall | |
| 6,906,675 | B2 * | 6/2005 | Satoh et al. | 343/767 |
| 7,176,843 | B2 * | 2/2007 | Shimasaki et al. | 343/795 |
| 7,330,158 | B2 * | 2/2008 | Harihara | 343/795 |
| 2004/0196188 | A1 | 10/2004 | Yeh | |

FOREIGN PATENT DOCUMENTS

| | | |
|---|---|---|
| EP | 1357634 | 10/2003 |
| JP | 2005117363 | 4/2005 |

* cited by examiner

*Primary Examiner*—Trinh V Dinh
(74) *Attorney, Agent, or Firm*—Lucas & Mercanti, LLC

(57) ABSTRACT

An antenna device reduced in size and increased in bandwidth. The antenna device comprises a first radiating plate and a second radiating plate arranged with a space with a predetermined width. A power supply part feeding a power to the first radiating plate and the second radiating plate is installed in the space. The first radiating plate and the second radiating plate are characterized in that they are similar to each other in plan view shape and different in size from each other.

6 Claims, 7 Drawing Sheets

1
20
CL
C1
C2
C1a
C1b
r1
r2
L1
L3
L4
L5
L6
L7
L8
L9
L10
L11
L12
L13
L21
L22
L23
L24
L25
L26
L27
L28
3
3a
3b
4
4a
4b
5
5a
5b
6
7
8
11

ANTENNA APPARATUS

RELATED APPLICATIONS

This application is a 371 of PCT/JP2006/316208 filed Aug. 18, 2006, which claims priority under 35 U.S.C. 119 to an application JP 2005266935 filed on Sep. 14, 2005, the contents of which are incorporated herein by reference.

FIELD OF THE INVENTION

The present invention relates to an antenna apparatus, particularly to an antenna apparatus for UWB (Ultra Wide Band).

BACKGROUND

A UWB antenna apparatus is known in the conventional art as an antenna apparatus capable of using the frequency band characterized by an ultra wide-band. The UWB in the sense in which it is used here refers to the ultra wide-band in a wireless transmission system using a wide-band frequency width (several GHz through several tens of GHz) wherein a short pulse of 1 ns or less is employed. The UWB antenna apparatus is characterized by ultra low output transmission and very small interference with other wireless communications.

For example, the UWB antenna apparatus 50 is known in the conventional art, as shown in FIG. 11. This antenna apparatus is provided with a pair of radiating plates (conducting plates) 51, 51. The radiating plates 51 are semicircular in plan view, and are arranged at a space having a predetermined width while the arc vertexes of the radiating plates 51 are kept face to face with each other. The arc vertex of each of the radiating plates 51 is provided with a power supply section 54 that is connected with a coplanar strip line as a balanced line 53. When a predetermined current is fed from the balanced line 53 to the power supply section 54, the radiating plates 51 resonate in response to the current, with the result that radio wave is emitted from one or both ends thereof.

Still another antenna apparatus known in the conventional art is an antenna apparatus wherein the available bandwidth is increased by using the self-similar radiating plates shown in FIG. 12. The radiating plates of this antenna apparatus are self-similar and have an isosceles triangle in plan view, and hence this antenna apparatus is characterized by the principle of self-similarity which is independent of the frequency, in such a way that resonance is possible even in the high frequency area. In FIG. 12, the radiating plate of FIG. 12 (*a*) is greater in size than that of FIG. 12 (*b*). Their available bands are indicated by BWa and BWb, respectively.

One of the conventionally known indicators showing the characteristics of the antenna apparatus is the VSWR characteristic curve represented in a chart wherein the VSWR (Voltage Standing Wave Ratio) value is plotted on the vertical axis, and frequency is plotted on the horizontal axis. The VSWR characteristic curve is designed to assume the minimum value in the frequency wherein the radiating plates resonate. The frequency at which the radiating plates resonate is determined in proportion to the distanced from the power supply section to one end of the radiating plate. Accordingly, the VSWR characteristic curve differs according to the size of the radiating plate; thus, as the size of the radiating plate is greater, the minimum frequency for resonance is lower. Generally, the frequency band wherein VSWR value $\leqq 2.0$ corresponds to the band where the antenna apparatus can be employed. The self-similar antenna apparatus is designed in such a way that, as the minimum frequency is lower, the available band has a greater bandwidth.

Thus, to implement the antenna apparatus having a wideband characteristic, it has been essential in the conventional art to increase the size of the radiating plate in order to reduce the minimum frequency. Further, the UWB antenna apparatus uses an increased band frequency width, and this makes it difficult to achieve resonance with a great number of frequency components contained therein. To put it another way, as the frequency of the radio wave to be sent and received is increased in bandwidth, the designing of the antenna apparatus becomes more difficult. This problem remains unsolved in the conventional art.

In an effort to solve this problem, an antenna apparatus has been developed and disclosed in the Patent Document 1. This is an antenna apparatus of an increased level of freedom having a wideband characteristic. In this antenna apparatus, a power supply section is arranged at a predetermined position of the space between radiating plates. The current fed from the power supply section is transmitted in such a direction that a self-similar shape can be easily created. Thus, a wideband characteristic is obtained.

Patent Document 1: Unexamined Japanese Patent Application Publication No. 2005-117363

DISCLOSURE OF INVENTION

Problems to be Solved by the Invention

However, the conventional antenna apparatus 50 is a so-called balanced antenna wherein the radiating plates 51, 51 having almost the same shape are arranged to form a line symmetry with respect to the power supply section 54, as shown in FIG. 11. Accordingly, the power supply section 54 cannot be directly connected with the unbalanced line. To connect the balanced line 53, an unbalanced-balanced conversion circuit 55 or impedance conversion circuit must be employed. This has made it essential to increase the size of the entire antenna apparatus 50, in the conventional art.

Another problem in the conventional art is that the size of the radiating plate must be increased in order to further increase the bandwidth, as shown in FIG. 12.

The object of the present invention is to solve above-mentioned problems and to provide a UWB antenna apparatus characterized by reduced size and increased bandwidth.

Means for Solving the Problems

To solve above-mentioned problem, the invention provides an antenna apparatus comprising: a first radiating plate; a second radiating plate arranged with a space having a predetermined width between the second radiating plate and the first radiating plate; and a power supply section for supplying power to the first radiating plate and the second radiating plate provided in the space, wherein the antenna apparatus is characterized in that the first radiating plate and the second radiating plate are similar to each other in plan view shape and are different from each other in size.

According to one form of the invention, the first radiating plate and second radiating plates arranged with the space having the predetermined width between the second radiating plate and the first radiating plate are similar to each other in the plan view shape and are different from each other in size in such a way that the distance of the first radiating plate from the space to one end of the first radiating plate is different from that of the second radiating plate. Since the resonance frequency of the radiating plate is determined by the distance from the space to one end of the radiating plate, difference in this distance causes a difference in the resonance frequency, hence an increase in the number of resonance points.

Further, this antenna is an unbalanced antenna wherein the first and second radiating plates are similar to each other in plan view shape and are different from each other in size. Thus, the impedance of each radiating plate as viewed from the power supply section is reduced and the unbalanced line is directly connected to supply power.

The invention of Claim 2 in one form provides the same antenna apparatus as described above except that each of the first radiating plate and the second radiating plate has a symmetry plane shape in plan view.

According to one form of the invention, each of the first and second radiating plates has a symmetry plane shape in plan view, so that the electric current is transmitted along each of the radiating plates from the power supply section and the radio wave is radiated uniformly.

The invention provides the same antenna apparatus as described above except that at least one of the first radiating plate and the second radiating plate is so arranged that a center point of a straight line connecting both ends in a lateral direction and the power supply section are located on a center line, and the straight line is arranged not to cross the center line.

According to one form of the invention, at least one of the first and second radiating plates is so arranged that the center point of the straight line connecting both ends in the lateral direction and the power supply section are located on the center line, and the straight line is arranged not to cross the center line. Thus, the distances from the power supply section are different on both ends of the straight line. Since the resonance frequency is determined by the distance from both ends of the radiating plates and the power supply section, a difference in the distance between the straight line and power supply section causes a difference in the resonance frequency, hence an increase in the number of the resonance points from the radiating plate whose straight line cross the center line.

The invention in one form provides the same antenna apparatus as that described immediately above except that at least one of the first and second radiating plates has a circular arc, and the straight line passes through both ends of the circular arc and the power supply section is arranged on the circular arc.

According to one form of the invention, at least one of the first radiating plate and the second radiating plate has a circular arc as one arc-shape side, and the power supply section is arranged on this circular arc. Thus, the power supply section can be mounted on a desired position of the arc, even if the radiating plates are arranged in such a way that the straight line does not cross the center line.

The invention in one form provides the same antenna apparatus as that described above except that at least one of the first radiating plate and the second radiating plate is so arranged that a center point in the lateral direction and the power supply section are located on a reference line, and the straight line connecting both ends in the lateral direction is arranged not to cross the reference line.

According to one form of the invention, the center point of the radiating plate in the lateral direction and the power supply section are located on the reference line, so that the radio wave is radiated from the center position of the radiating plate in the lateral direction. Further, the straight line connecting both ends of at least one of the radiating plates in the lateral direction is arranged not to cross the reference line. This arrangement causes a difference in the distances from the power supply section on both ends of the straight line. Since the resonance frequency is determined by the distance between both ends of the straight line and the power supply section, this arrangement causes a difference in the resonance frequency on both ends of the straight line and an increase in the number of the resonance points according to the radiating plate whose straight line crosses the reference line.

The invention in one form provides the same antenna apparatus as that described immediately above except that at least one of the first radiating plate and the second radiating plate has a circular arc, and the straight line passes through both ends of the circular arc and the power supply section is arranged on the circular arc.

According to one form of the invention, at least one of the first and second radiating plates has a circular arc as one circular side, and the power supply section is arranged on this circular arc. Thus, the power supply section can be mounted on a desired position of the arc, even if the radiating plates are arranged in such a way that the straight line does not cross the center line.

EFFECTS OF THE INVENTION

According to the invention, when using the first and second radiating plates which are similar to each other in the plan view and are different from each other in the size, the number of resonance points is increased and the bandwidth is also increased as compared to the antenna apparatus using two radiating plates having almost the same shape.

Further, this antenna is an unbalanced antenna wherein the first and second radiating plates are different from each other in the size. This makes it possible to connect the unbalanced line directly to supply power, eliminating the need of separately installing an unbalanced/balanced conversion circuit or impedance conversion circuit, with the result that the overall dimensions of the antenna apparatus can be reduced.

According to the invention, the radio wave is emitted uniformly to the right and left. This arrangement improves the emission pattern and ensures uniform directivity.

According to one form of the invention, the straight line of at least one of the first and second radiating plates does not cross the center line, and therefore, the number of resonance points is increased and the bandwidth is also increased.

According to one form of the invention, the power supply section can be mounted on a desired position of the arc in response to the width of the space between the radiating plates, so that the impedance can be adjusted According to one form of the invention, the straight line of at least one of the first and second radiating plates does not cross the reference line, and therefore, the number of resonance points is increased and the bandwidth is also increased. Further, since the center position of the radiating plate in the lateral direction is located on the reference line, the radio wave is radiated from the center position in the lateral direction of the radiating plate. This arrangement provides extremely uniform directivity of the antenna apparatus and improves the radiation pattern.

According to one form of the invention, the power supply section can be mounted on a desired position of the arc in response to the width of the space between the radiating plates, so that the impedance can be adjusted.

DESCRIPTION OF REFERENCE NUMERALS

Figure 1:
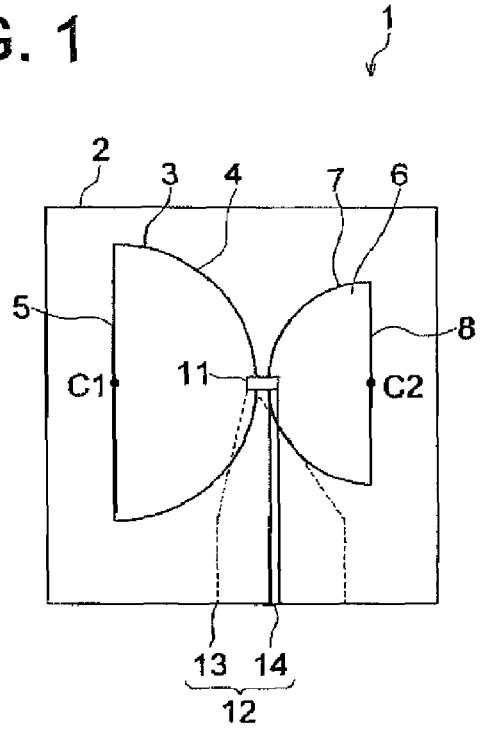
FIG. 1 is a plan view of the antenna apparatus as a first embodiment.

1, 20, 30 antenna apparatuses
2 Electronic substrate
3 First radiating plate
4 First circular arc
5 First straight line
6 Second radiating plate
7 Second circular arc
8 Second straight line
11 Power supply section
12 Unbalanced line
13 Ground line
14 Strip line

BEST MODE FOR CARRYING OUT THE INVENTION

The following describes the embodiments of the antenna apparatus of the present invention with reference to drawings, without the present invention being restricted thereto.

Embodiment 1

The following describes the structure of the antenna apparatus 1 as a first embodiment.

Figure 2:
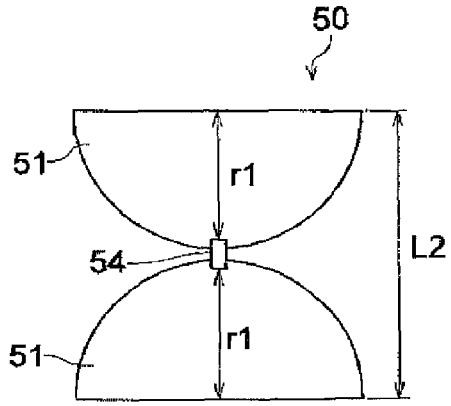
FIG. 2 (a) PRIOR ART
FIG. 2 (*a*) is a plan view of the conventional radiating plate and power supply section, and FIG. 2 (*b*) is a plan view of the radiating plate and power supply section in the first embodiment.
Figure 2:
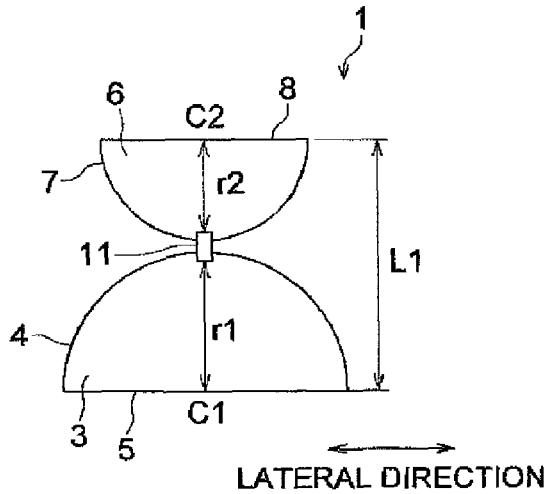

As shown in FIG. 1, the antenna apparatus 1 of the present invention is provided with an electronic substrate 2. A first radiating plate 3 of semicircular shape in the plan view is arranged on the upper side of the electronic substrate 2. As shown in FIG. 2 (*b*), the first radiating plate 3 is formed of a radius r1 wherein a center point C1 is used as the center of a circle. As shown in FIG. 2 (*b*), the first radiating plate 3 is provided with a first circular arc 4 as one arc-shaped side, and a first straight line 5 of linear shape passing through both ends of the first circular arc 4 and the center point C1.

The second radiating plate 6 exhibiting the plan view similar to the first radiating plate 3 is mounted on the upper side of the electronic substrate 2 located face to face with the vertex of the circular arc of the first radiating plate 3, wherein the vertexes of the circular arc are positioned face to face with each other. The second radiating plate 6 has a radium r2, wherein the circle center thereof is used as the center point C2. The radius r2 of the second radiating plate 6 is smaller than the radius r1 of the first radiating plate 3. The second radiating plate 6 is provided with a second circular arc 7 as one arc-shaped side and a linear second straight line 8 passing through both ends of the second circular arc 7 and the center point C2.

The first radiating plate 3 and second radiating plate 6 are made of aluminum, copper or others. There is no restriction to the size of the first radiating plate 3 and second radiating plate 6 if only the shape in the plan view is similar to each other. Further, there is no restriction to the plan view shape of the first radiating plate 3 and second radiating plate 6. However, from the viewpoint of improving the radiation pattern of the radio wave to be sent and received, a symmetric surface shape is preferred. The symmetric surface shape in the sense in which it is used here refers to the form of a surface having line symmetry with reference to the line which passes through the center position of the radiating plate in the longitudinal direction and is perpendicular to the longitudinal direction.

Figure 3:
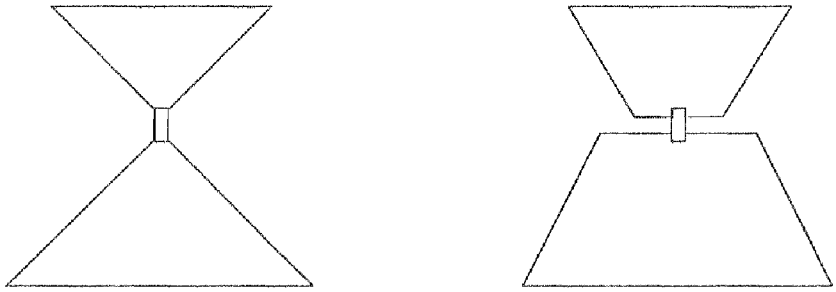
FIG. 3 is a plan view showing another form of the radiating plate and power supply section in the first embodiment.
Figure 12:
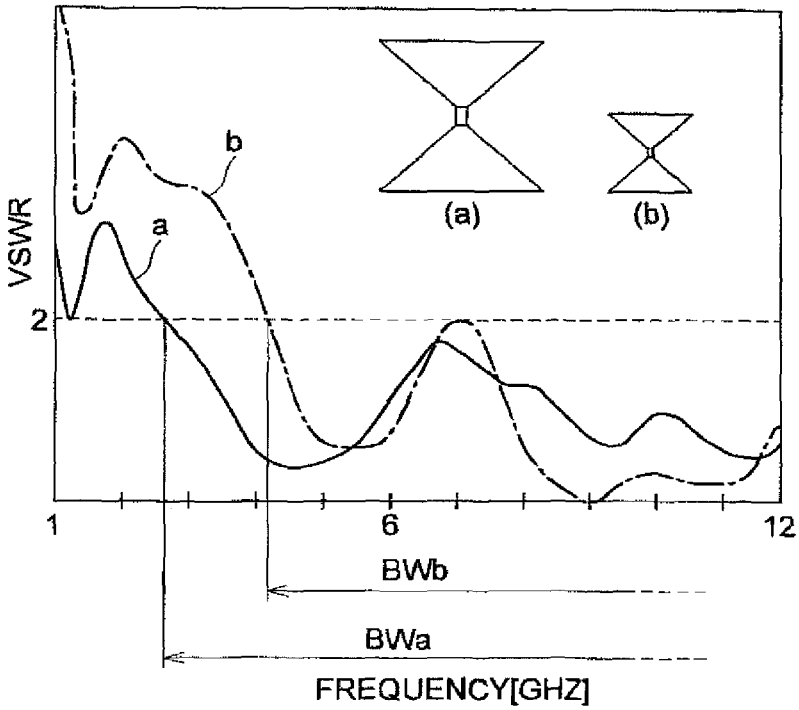
FIG. 12 PRIOR ART
FIG. 12 is a chart representing the VSWR characteristic curve of a conventional antenna apparatus.

The radiating plate having symmetry with respect to a plane can be exemplified by the isosceles triangular or trapezoidal radiating plate shown in FIG. 3. When an isosceles triangular radiating plate is to be employed, the vertexes sandwiched between the sides having the same length or other same dimensions are placed face to face with each other. When a trapezoidal radiating plate is utilized, the upper sides are placed face to face with each other. Further, a self-similar shape such as an isosceles triangle can easily be assigned with the ratio of similitude of a geometric area corresponding to each wavelength, and a great many resonance points can be obtained in the high frequency area (FIG. 12).

The first radiating plate 3 and second radiating plate 6 are arranged in such a way that a space having a predetermined width is provided between the vertexes of circular arcs. The impedance of the antenna apparatus 1 is determined by the width of this space. Generally, to get an impedance of about 50 ohms, the width of the space preferably lies in the range of 0.5 through 1 mm, independently of the shape or size of the radiating plate.

As shown in FIG. 1, the vertexes of the circular arcs in the first radiating plate 3 and second radiating plate 6 are provided with a power supply section 11 which supplies current to each of the radiating plates. The first radiating plate 3 and second radiating plate 6 are similar to each other in the plan view and are different in size, and therefore, the unbalanced line 12 is directly connected with the power supply section 11 so that power is supplied. The unbalanced line 12 is exemplified by a coaxial power supply cable and micro-strip line. The unbalanced line 12 is provided with a ground line 13 connected to the vertex of the first radiating plate 3 and a strip line 14 connected to the vertex of the second radiating plate 6. The unbalanced line 12 extends over to the edge of the electronic substrate 2, so that it can be connected with an electronic device (not illustrated) that processes the electric signal of radio wave having been transmitted and received.

The following describes the procedure of transmission and reception of the radio wave by the antenna apparatus 1 of the present embodiment:

When the radio wave is transmitted by the antenna apparatus 1, the current having a predetermined amplitude and phase is supplied to each of the first radiating plate 3 and second radiating plate 6 through the unbalanced line 12 according to the electric signal from an electrical device. The current having been sent to the first radiating plate 3 and second radiating plate 6 is sent from the power supply section 11 to the first straight line 5 and second straight line 8 along each of the radiating plates. Then the first radiating plate 3 and the second radiating plate 6 start resonance at a predetermined frequency so that radio wave is sent from the center points C1 and C2.

When the antenna apparatus 1 is to receive the radio wave, the first radiating plate 3 and second radiating plate 6 start resonating when the radio wave having a predetermined frequency has been received from the first straight line 5 or second straight line 8. Then the current corresponding to this resonance frequency is produced by the power supply section 11. The current having been produced is transmitted to the electronic device through the unbalanced line 12.

Here the resonance frequency of the antenna apparatus 1 corresponds to the distance from the power supply section 11 to the first straight line 5 or second straight line 8. The half-wave at the resonance point is determined in proportion to radiuses r1 and r2. Further, the resonance frequency also corresponds to the distance L1 from the first straight line 5 to the second straight line 8, and the half-wave of the resonance point is determined in proportion to the L1. The frequency is more reduced as the wavelength is longer. Accordingly, the minimum frequency is lower as the distance L1 for determining the wavelength at the greatest resonance point is longer.

Figure 4:
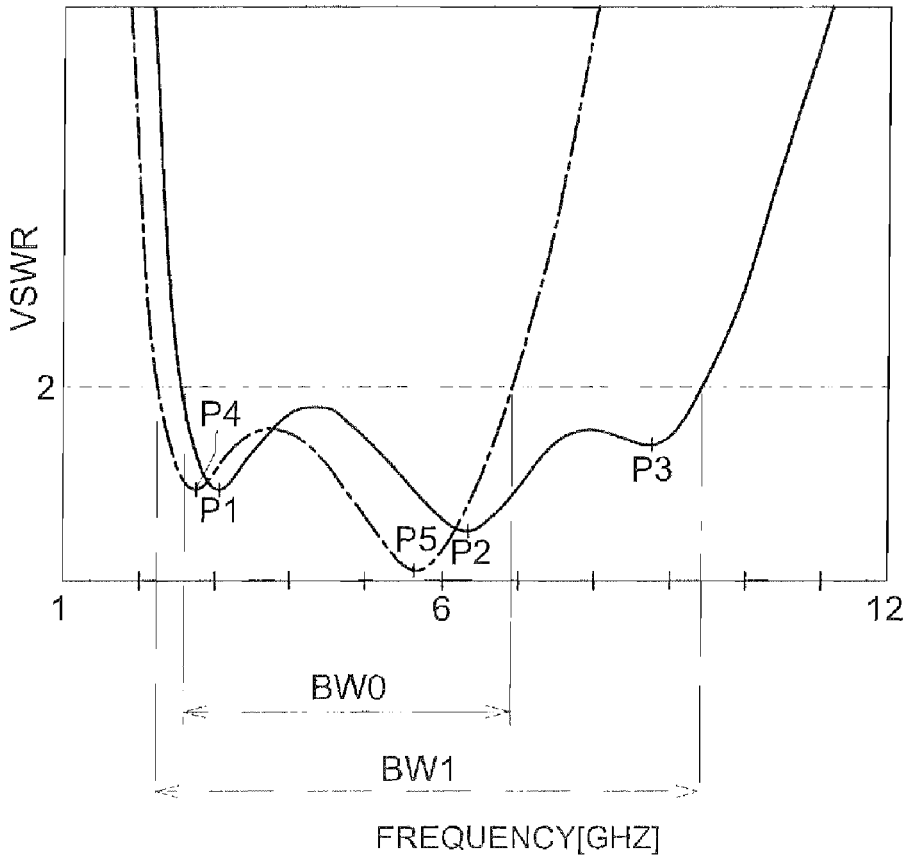
FIG. 4 is a chart representing the VSWR characteristic curve of the antenna apparatus as the first embodiment and the conventional antenna apparatus.

The following describes the VSWR characteristic curve of the antenna apparatus 1:

As shown in FIG. 4, the resonance point P1 determined by the distance L1, the resonance point P2 determined by the radius r1, and the resonance point P3 determined by the radius r2 can be mentioned in ascending order of frequency as the resonance points of the antenna apparatus 1.

In the conventional antenna apparatus 50, the radiating plates 51 are semicirculars in the plan view and have a radius of r1, as shown in FIG. 2 (*a*). The radiating plates 51 have the vertexes of respective circular arcs placed face to face with each other, and are arranged at a space having a predetermined width. The power supply section 54 is connected to this space. The resonance point P4 determined by the distance L2 between the ends of the radiating plates 51 and the resonance point P5 determined by the radius r1 of the radiating plate 51 can be mentioned as the resonance points of the antenna apparatus 50 in ascending order of frequency.

In the antenna apparatus 50, there is an increase in the number of the resonance points and the VSWR value assumes the minimum value at each resonance point. This provides the available band BW1 which is increased in bandwidth over the available hand BWO of the antenna apparatus 50. Further, the radius r2 of the second radiating plate 6 is smaller than the radius r1 of the first radiating plate 3 and the radiating plate of the conventional antenna apparatus. This allows the antenna apparatus 1 itself to be downsized.

Since the unbalanced line 12 can be connected to the power supply section 11, power can be easily supplied. Further, there is no need of installing the unbalanced/balanced conversion circuit. This arrangement allows the antenna apparatus 1 itself to be downsized and simplified.

In the present embodiment, the first radiating plate 3 and second radiating plate 6 exhibit a plane of symmetry in the plan view, and this structure can be modified as adequate. When the radiating plate having a plane of symmetry is used, a power supply section is provided at the center of the space between the radiating plates. This allows the radiation pattern from the radiating plate to exhibit bilateral symmetry, with the result that directivity can be made uniform.

Embodiment 2

Figure 5:
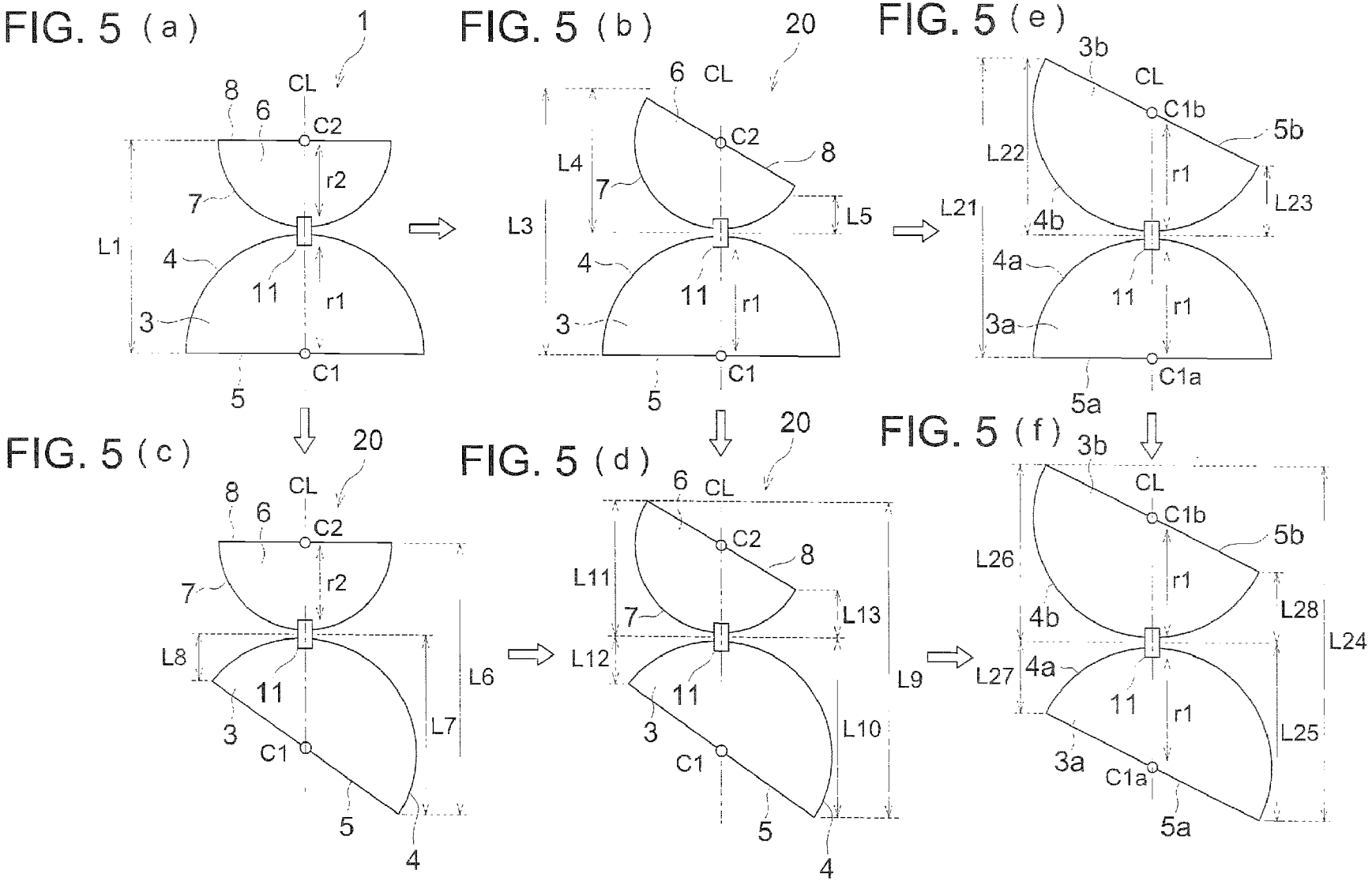
FIGS. 5(*a*) 5(*b*), 5(*c*), 5(*d*), 5(*e*) and 5(*f*) are plan views representing the radiating plate and power supply section in a second embodiment.

Referring to FIG. 5, the following describes the structure of the antenna apparatus 20 of the second embodiment. The same structures as those of the first embodiment are assigned with the same numerals of reference.

The antenna apparatus 20 of the present embodiment includes the same electronic substrate as that of the first embodiment. The upper side of the electronic substrate is provided with the same first radiating plate 3 with radius r1 and center point C1 as that of the first embodiment. As shown in FIG. 5 (*b*), the second radiating plate 6 similar to the first radiating plate 3 is arranged at the position face to face with the first circular arc 4. The second radiating plate 6 is designed to have the radius r2 and center point C2. Assuming that the line connecting the center points C1 and C2 forms a center line CL, the first radiating plate 3 is arranged in such a way that the first straight line 5 is perpendicular to the center line CL. The second radiating plate 6 is so designed that the second straight line 8 does not cross the center line CL.

A power supply section 11 to be connected with the first radiating plate 3 and second radiating plate 6 is installed on the center line CL wherein the first radiating plate 3 and second radiating plate 6 lie closest to each other. The power supply section 11 is connected with an unbalanced line 12, similarly to the case of the first embodiment, so that a predetermined current can be supplied.

The procedure of transmitting and receiving the radio wave in such an antenna apparatus 20 is the same as that in the first embodiment. Power is supplied through the unbalanced line 12 and power supply section 11, and radio wave is transmitted and received from the center points C1 and C2 of a radiating plate.

Figure 6:
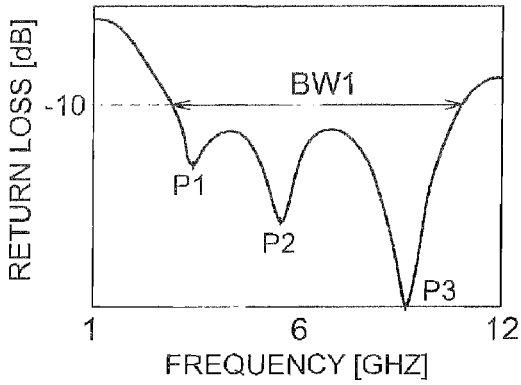
FIGS. 6 (*a*), 6(*b*), 6(*c*) and 6(*d*) are charts showing the return loss of the antenna apparatus in the second embodiment.
Figure 6:
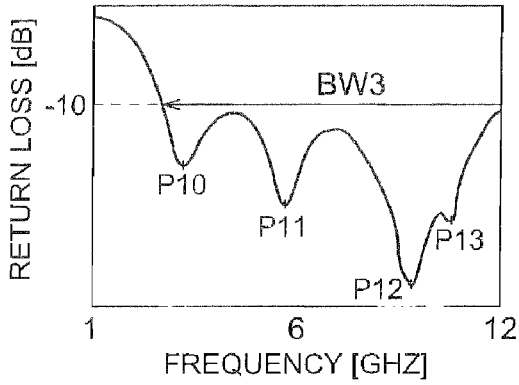
Figure 6:
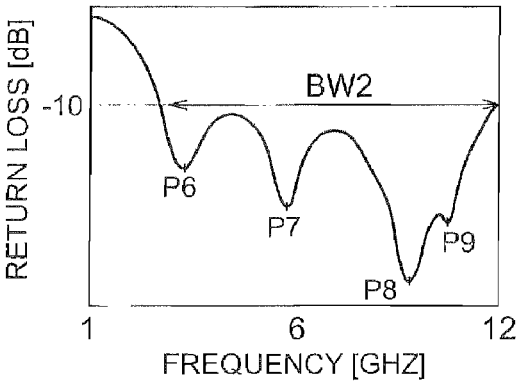
Figure 6:
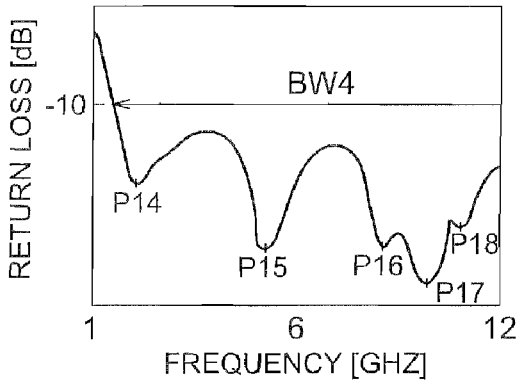

FIG. 6 (*b*) shows the antenna characteristic curve of antenna apparatus 20.

Here, the return loss that can be obtained from the ratio of the input voltage to the reflected voltage can be mentioned as another indicator of the antenna characteristic. The return loss is also called the reflection coefficient. As this value is smaller, better matching is provided as an antenna apparatus. Generally, the available band can be found when this value is −10 or less. The return loss is proportional to the VSWR characteristic, and can be easily obtained from the VSWR characteristic.

As described above, the resonance frequency is determined by the distance from the power supply section 11 to the first straight line 5 or second straight line 8. In the present embodiment, the second straight line 8 is inclined, as shown in FIG. 5 (*b*), and the distances from the power supply section 11 are different on the right and left ends of the second straight line 8. To put it in greater details, the resonance point P6 corresponding to the distance L3 from the first straight line 5 to the left end of the second straight line 8, the resonance point P7 corresponding to the radius r1 as the distance from the power supply section 11 to the first straight line 5, the resonance point P8 corresponding to the distance L4 from the power supply section 11 to the left end of the second straight line 8, and the resonance point P9 corresponding to the distance L5 from the power supply section 11 to the right end of the second straight line 8, appear in order of ascending frequency, as shown in FIG. 6 (*b*).

In the meantime, when the first straight line 5 and second straight line 8 are perpendicular to the center line CL as in the case of the antenna apparatus 1 of the first embodiment, the three resonance points P1, P2 and P3 appears, as shown in FIG. 6 (*a*). Thus, the antenna apparatus 20 has an increased number of the resonance points, hence provides the available band BW2 which is increased in the bandwidth over the available band BW1 of the antenna apparatus 1 in the first embodiment.

As described above, the antenna apparatus 20 has the second straight line 8 which is inclined with respect to the center line CL, and the number of the resonance points is thus increased. Accordingly, the available band can be expanded without having to increase the size of the radiating plate.

Further, each radiating plate is semicircular in the plan view and the first circular arc 4 and second circular arc 7 are provided with a power supply section 11. Thus, the power supply section 11 can be mounted at a desired position of each circular arc. The power supply section 11 can be installed easily even if the second straight line 8 is inclined with respect to the center line CL. There is no change in the width of the space between the first radiating plate 3 and second radiating plate 6, and it is possible to prevent the impedance from being changed.

In the antenna apparatus 20, only the second straight line 8 is inclined with respect to the center line CL. It is only required that the straight line of at least one of the first radiating plate 3 and second radiating plate 6 should be inclined. For example, it is also possible to make such arrangements that only the first straight line 5 is inclined, and the second straight line 8 is perpendicular to the center line CL, as shown in FIG. 5 (*c*).

In the antenna characteristic curve in this case, the resonance point P10 corresponding to the distance L6 from the right end of the first straight line 5 to the second straight line 8, the resonance point P11 corresponding to the distance L6 from the power supply section 11 to the right end of the first straight line 5, the resonance point P12 corresponding to the radius r2 as the distance from the power supply section 11 to the second straight line 8, and the resonance point P13 corresponding to the distance L8 from the power supply section 11 to the left end of the first straight line 5 appear in ascending order of frequency, as shown in FIG. 6 (*c*). To put it another way, there are four resonance points, and this arrangement provides the available band BW3 further increased in bandwidth.

It is also possible to make such arrangements that the first straight line 5 and second straight line 8 are inclined with respect to the center line CL. For example, in the antenna characteristic curve wherein both the first straight line 5 and second straight line 8 are inclined as shown in FIG. 5 (*d*), the resonance point P14 corresponding to the distance L9 from the right end of the first straight line 5 to the left end of the second straight line 8, the resonance point P15 corresponding to the distance L10 from the power supply section 11 to the right end of the first straight line 5, the resonance point P16 corresponding to the distance L11 from the power supply section 11 to the left end of the second straight line 8, the resonance point P17 corresponding to the distance L12 from the power supply section 11 to the left end of the first straight line 5, and the resonance point P18 corresponding to the distance L13 from the power supply section 11 to the right end of the second straight line 8 appear in ascending order of frequency. To put it another way, there are five resonance points, and this arrangement provides the available band BW4 still further increased in bandwidth.

The antenna apparatus 20 of the present embodiment described above is provided with the first radiating plate 3 and second radiating plate 6 similar to each other in the plan view and different from each other in the size. It is also possible to arrange such a configuration that the first radiating plate 3 and second radiating plate 6 have the same size. For example, it is also possible to arrange such a configuration, as shown in FIG. 5 (*e*), that only the second straight line 5*b* is inclined with respect to the center line CL, and both the first radiating plate 3*a* and second radiating plate 3*b* have the same size of radius r1.

In the antenna characteristic curve (not illustrated) in this case, the resonance point corresponding to the distance L21 from the first straight line 5*a* to the left end of the second straight line 5, the resonance point corresponding to the distance L22 from the power supply section 11 to the left end of the second straight line 5*b*, the resonance point corresponding to the radius r1 as the distance from the power supply section 11 to the first straight line 5*a*, and the resonance point corresponding to the distance L23 from the power supply section 11 to the right end of the second straight line 5*b* appear in ascending order of frequency. To put it another way, there are four resonance points, and this arrangement provides the available band further increased in bandwidth.

As shown in FIG. 5 (*f*), it is also possible to make such arrangements that the first straight line 5*a* and second straight line 5*b* are inclined with respect to the center line CL, and both the first radiating plate 3*a* and second radiating plate 3*b* have the same size of radius 1*r*.

In the antenna characteristic curve (not illustrated) in this case, the resonance point corresponding to the distance L24 from the right end of the first straight line 5*a* to the left end of the second straight line 5*b*, the resonance point corresponding to the distance L25 from the power supply section 11 to the right end of the first straight line 5*a*, the resonance point corresponding to the distance L26 from the power supply section 11 to the left end of the second straight line 5*b*, the resonance point corresponding to the distance L28 from the power supply section 11 to the right end of the second straight line 5*b*, and the resonance point corresponding to the distance L27 from the power supply section 11 to the left end of the first straight line 5*a* appear in ascending order of frequency. To put it another way, there are five resonance points, and this arrangement provides the available band further increased in bandwidth.

As described above, even if the first radiating plate 3 and second radiating plate 6 have the same size, the number of the resonance points can be increased and the available band can be increased in the bandwidth, if the first straight line 5*a* and/or second straight line 5*b* is inclined with respect to the center line CL.

Figure 7:
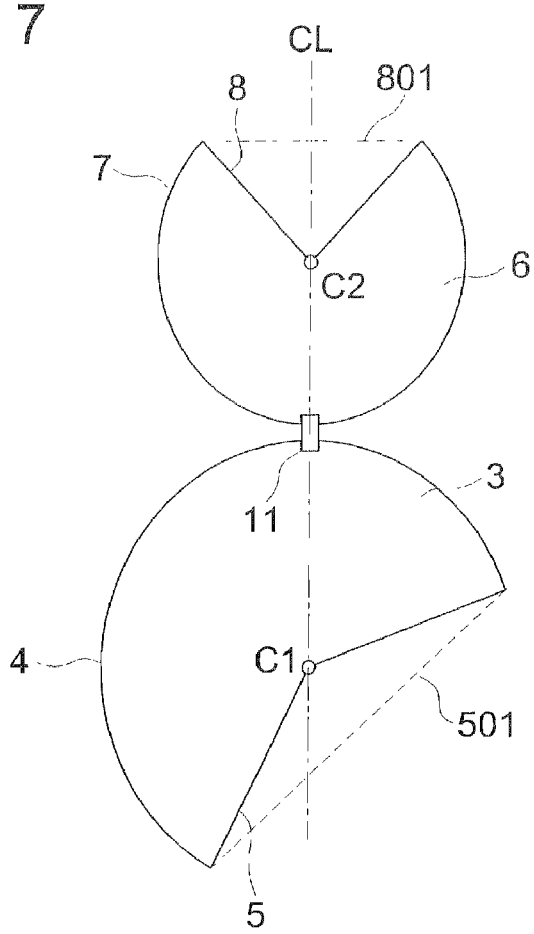
FIG. 7 is a plan view showing another form of the radiating plate and power supply section in the second embodiment.

In the present embodiment, the radiating plate having a semicircular shape in plan view is used. However, there is no restriction to the shape of the radiating plate in plan view. It is only required that at least one of the radiating plates should be arranged in such a way that the center point of the straight line connecting both ends in the lateral direction and the power supply section 11 are located on the center line CL, and the straight line is not perpendicular to the center line CL. The straight line connecting both ends in the lateral direction in the sense in which it is used here refers to the straight line that connects both ends of the radiating plate extending in the inclined state in the lateral direction. It is expressed by the straight line, independently of the shape of the end portion of the radiating plate. For example, as shown in FIG. 7, when the plan view shape of the first radiating plate 3 and second radiating plate 6 is a circle which is partly incomplete, the straight line connecting between both ends in the lateral direction is indicated by the mid-point lines 501 and 801. When the straight line 501 or 801 of at least one of the first radiating plate 3 and second radiating plate 6 is not perpendicular to the center line CL, the advantages of the present embodiment come into play.

Embodiment 3

The following describes the structure of the antenna apparatus 30 of the third embodiment: The same structures as those of the first embodiment are assigned with the same numerals of reference, and description is omitted to avoid duplication.

Figure 8:
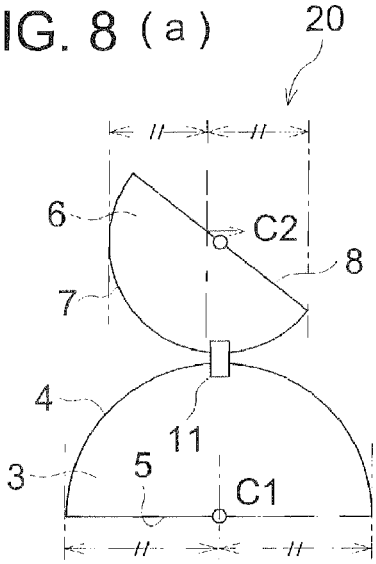
FIGS. 8(*a*) and 8(*b*) are plan views representing the radiating plate and power supply section in a third embodiment.
Figure 8:
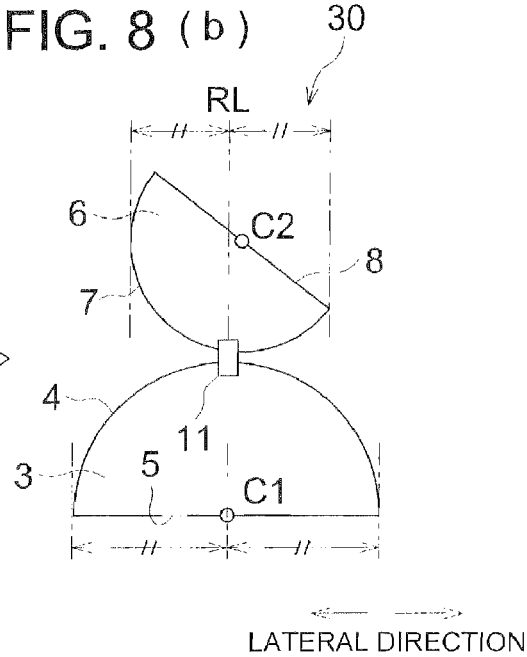

The antenna apparatus 30 is provided with the same electronic substrate as that of the first embodiment. The upper side of the electronic substrate is provided with the same first radiating plate 3 with radius r1 and center point C1 as that of the first embodiment. As shown in FIG. 8 (*b*), the second radiating plate 6 similar to the first radiating plate 3 is arranged at the position face to face with the first circular arc 4. The second radiating plate 6 is designed to have the radius r2 and center point C2.

Assuming that the line connecting the center position of the first radiating plate 3 in the lateral direction and the center position of the second radiating plate 6 in the lateral direction is a reference line RL, the first radiating plate 3 is arranged in such a way that the first straight line 5 is perpendicular to the reference line RL. The second radiating plate 6 is so designed that the second straight line 8 does not cross the reference line RL. The lateral direction in the sense in which it is used in the present embodiment refers to the direction perpendicular to the reference line RL, as shown in FIG. 8.

A power supply section 11 to be connected with the first radiating plate 3 and second radiating plate 6 is installed on the reference line RL wherein the first radiating plate 3 and second radiating plate 6 lie closest to each other. The power supply section 11 is connected with an unbalanced line 12, similarly to the case of the first embodiment, so that a predetermined current can be supplied.

The procedure of transmitting and receiving the radio wave in such an antenna apparatus 30 is the same as that in the first embodiment. Power is supplied through the unbalanced line 12 and power supply section 11, and radio wave is transmitted and received from the position wherein the reference line RL cross the first straight line 5 or second straight line 8.

Figure 9:
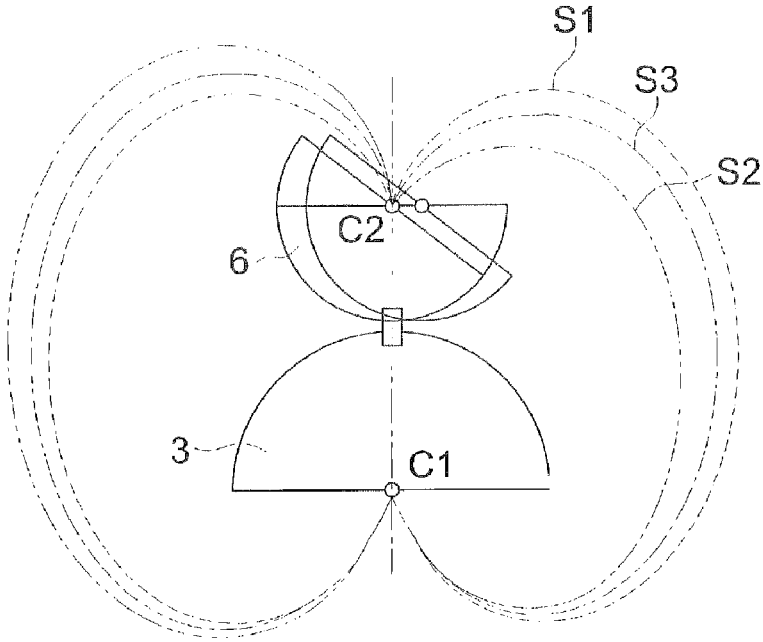
FIG. 9 is an explanatory diagram showing the radiation pattern in the third embodiment.

The following describes the radio wave radiation pattern by the antenna apparatus 30 of the present embodiment:

The antenna apparatus 30 radiates the radio wave from the reference line RL as a center, and the radiation pattern is illustrated by the one-dot chain line S3 in FIG. 1. In FIG. 9, a dotted line S1 denotes the radiation pattern of the antenna apparatus 1 of the first embodiment, while a two-dot chain line S2 denotes the radiation pattern of the antenna apparatus 20 of the second embodiment.

The antenna apparatus 1 of the first embodiment is so arranged that the first straight line 5 is parallel to the second straight line 8, and the radiation pattern from the first radiating plate 3 and second radiating plate 6 exhibits a display bilateral symmetry. The antenna apparatus 20 of the second embodiment is so arranged that the second straight line 8 is inclined with respect to the center line CL, and the radiation pattern is also inclined accordingly to exhibit a display bilateral asymmetry.

The antenna apparatus 30 of the present embodiment is so arranged that the second straight line 8 is inclined and the radiation pattern exhibits a display bilateral asymmetry, but the center position of the second radiating plate 6 in the lateral direction is located on the reference line RL. This arrangement ensures greater uniformity than that in the antenna apparatus 20 of the second embodiment.

As described above, the antenna apparatus 30 of the present embodiment allows the radiation pattern to be improved even when the second straight line 8 is inclined, and ensure more uniform directivity.

Figure 10:
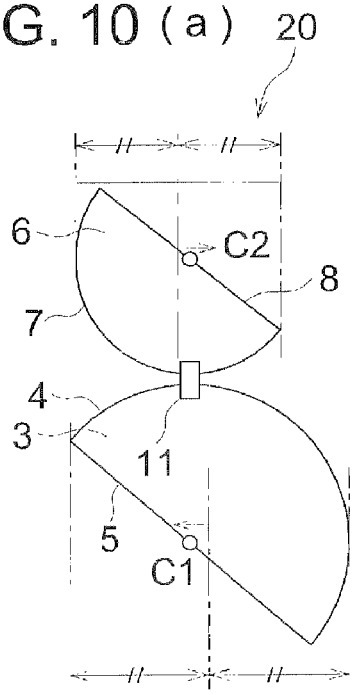
FIGS. 10(*a*) and 10(*b*) are plan views representing the radiating plate and power supply section in the third embodiment.
Figure 10:
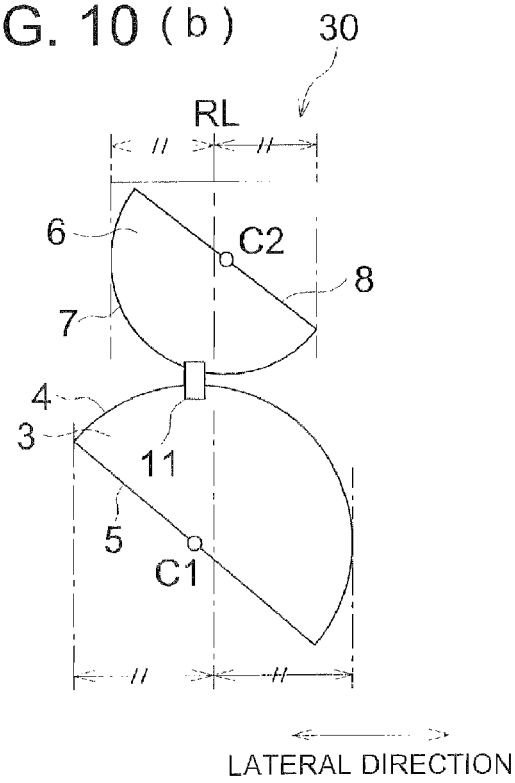
Figure 11:
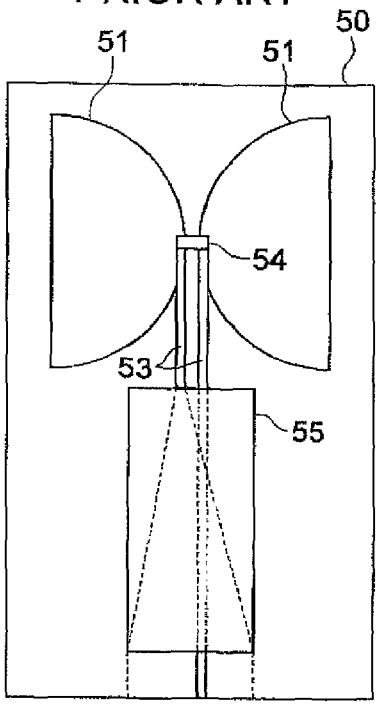
FIG. 11 PRIOR ART
FIG. 11 is a plan view of a conventional antenna apparatus.

As shown in FIG. 10 (*b*), when both the first straight line 5 and second straight line 8 are inclined, arrangements are made in such a way that the center of the first radiating plate 3 in the lateral direction, the center of the second radiating plate 6 in the lateral direction, and the power supply section 11 are located on the reference line RL.

This arrangement allows the radiation pattern to be improved, and ensure uniform directivity.

In the present embodiment, the radiating plate having a semicircular shape in plan view is used. However, there is no restriction to the shape of the radiating plate in plan view. It is only required that at least one of the radiating plates should be arranged in such a way that the center position in the lateral direction and the power supply section 11 are located on the reference line RL, and the straight line connecting both ends in the lateral direction is not perpendicular to the reference line RL. The straight line connecting both ends in the lateral direction in the sense in which it is used here refers to the straight line that connects both ends of the radiating plate extending in the inclined state in the lateral direction. It is expressed by the straight line, independently of the shape of the end portion of the radiating plate. Thus, when the radiating plate having the form shown in FIG. 7 is used, it is only required that arrangement is made by displacement toward the right in FIG. 7 so that the center position of the first radiating plate 3 in the lateral direction lies on the reference line RL. This arrangement ensures that the advantages of the present embodiment come into play, without the first straight line 501 (dotted line in FIG. 7) of the first radiating plate 3 crossing the reference line RL.

The invention claimed is:

1. An antenna apparatus comprising:

a first radiating plate;

a second radiating plate arranged with a space having a predetermined width between the second radiating plate and the first radiating plate; and a power supply section for supplying power to the first radiating plate and the second radiating plate provided in the space, wherein the first radiating plate and the second radiating plate have the same shape to each other in plan view shape but are different from each other in size, and wherein one of the first radiating plate and the second radiating plate is an enlargement of the other of the first radiating plate and second radiating plate.

2. The antenna apparatus as described in claim 1, wherein each of the first radiating plate and the second radiating plate has a symmetry plane shape in plan view.

3. The antenna apparatus as described in claim 1, wherein each of the first radiating plate and the second radiating plate has a straight-lined side, the power supply section is located on a center line connecting both center points of the two straight-lined sides of the first radiating plate and the second radiating plate, and the straight-lined side of at least one of the first radiating plate and the second radiating plate is so arranged not perpendicular to the center line.

4. The antenna apparatus as described in claim 3, wherein each of the first radiating plate and the second radiating plate has a circular arc, and the straight-lined side passes through both ends of the circular arc and the power supply section is arranged on the circular arc.

5. The antenna apparatus as described in claim 1, wherein each of the first radiating plate and the second radiating plate has a straight-lined side and a center position on a lateral line between both lateral ends thereof, the power supply section is located on a reference line connecting both the center positions, and the straight-lined side of at least one of the first radiating plate and the second radiating plate is so arranged not perpendicular to the reference line.

6. The antenna apparatus as described in claim 5, wherein each of the first radiating plate and the second radiating plate has a circular arc, and the straight line passes through both ends of the circular arc and the power supply section is arranged on the circular arc.

* * * * *